United States Patent [19]

Peck

[11] 3,942,452

[45] Mar. 9, 1976

[54] SKI LIFT

[75] Inventor: Truman C. Peck, Minneapolis, Minn.

[73] Assignee: Alpine Valley Resort, Inc., Milford, Mich.

[22] Filed: May 8, 1974

[21] Appl. No.: 468,194

Related U.S. Application Data

[62] Division of Ser. No. 863,642, Oct. 3, 1969, Pat. No. 3,810,427.

[52] U.S. Cl. ..... 104/229; 104/173 ST; 104/216

[51] Int. Cl.[2] ..... B61B 12/12

[58] Field of Search ..... 104/173 ST, 202, 204, 205, 104/216, 229, 231

[56] References Cited

UNITED STATES PATENTS

| | | | |
|---|---|---|---|
| 304,488 | 9/1884 | Barney | 104/231 |
| 2,772,639 | 12/1956 | Ingold | 104/202 |
| 3,349,720 | 10/1967 | Pender | 104/173 ST |

*Primary Examiner*—Evon C. Blunk
*Assistant Examiner*—Robert Saifer
*Attorney, Agent, or Firm*—Dugger, Johnson & Westman

[57] ABSTRACT

A ski lift is provided having cars riding in a track up the slope by means of a rope trained about two wheels at opposite ends of the slope. The cars are manually engaged with the rope but are so designed that they may not be manually disengaged from the rope during their upward travel.

6 Claims, 7 Drawing Figures

SKI LIFT

This application is a division of my copending application Ser. No. 863,642, filed Oct. 3, 1969 for SKI LIFT, now U.S. Pat. No. 3,810,427.

This invention relates to ski lifts and in particular provides a ski lift wherein the skier may sit down during the trip up the slope as contrasted with conventional rope tows.

One object of the invention is to provide a ski lift which is in part controlled by the skier so that the beginning of the trip up the slope is under the skier's control.

Another object of the invention is to provide a ski lift that will not disengage and cannot be disengaged by the skier during the ride up the slope, thus preventing the car from sliding backward into other skiers.

Still another object of the invention is to provide an economical ski lift of considerably less expense than lifts of the chair type.

Still another object of the invention is to provide for the portability of the ski tow thus permitting it to be moved to alternate sites.

These and other objects of the invention will be apparent to those skilled in the art from the following specification an drawings in which.

Figure 1:
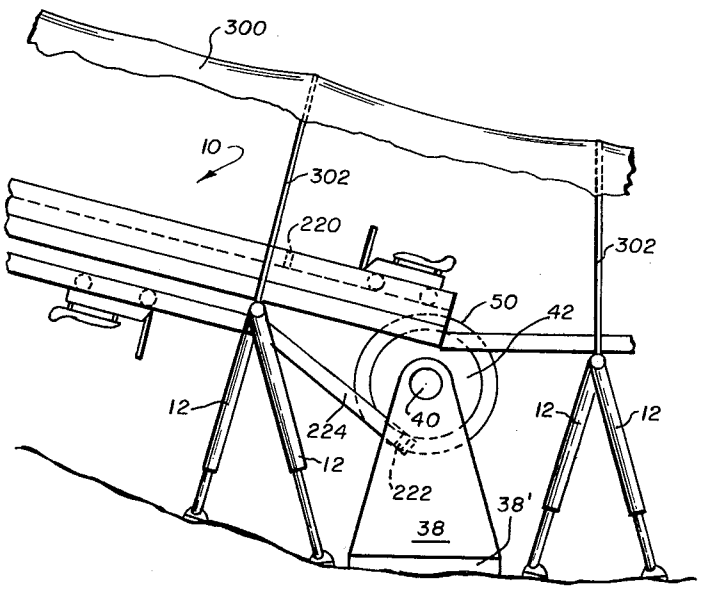
FIG. 1 is a side elevation of the invention with the shelter broken away.
Figure 2:
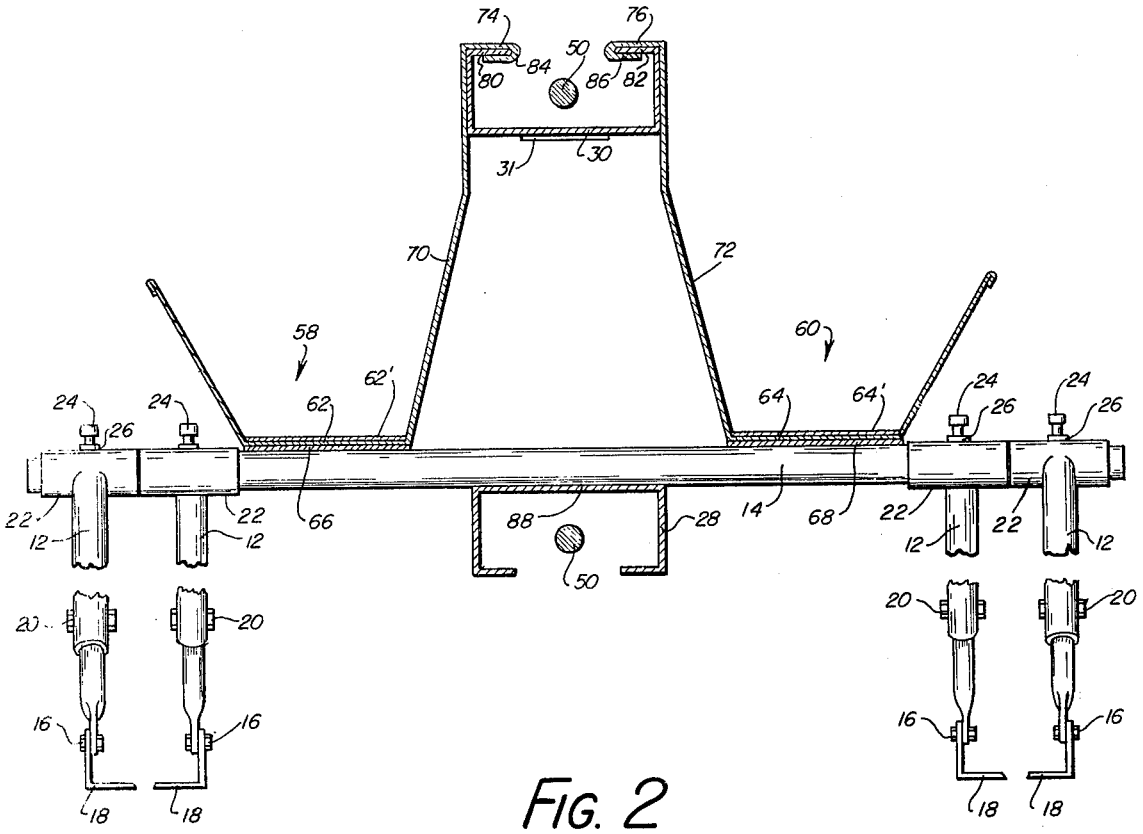
FIG. 2 is an enlarged cross section taken on line 2—2 of FIG. 1.

FIG. 1 shows the ski lift of this invention, generally indicated by the reference numeral 10 as comprising a plurality of support legs 12 extending downwardly from tubular cross supports 14. As best shown in FIG. 2 the legs 12 are tubular and telescopic in order to adjust the height of the support bar 14 above the slope. The bottom end of the legs 12 have bolted thereto at 16 foot pads 18 for engagement with the surface of the slope. The legs 12 telescope by virtue of the bolt and nut arrangement shown at 20.

While, as shown, the legs 12 are supported by foot pads 18, short (say 18 inches long) pegs or stakes may be provided to drive into the ground and used with or without the foot pads 18. In this way, ample stability and support is provided while at the same time permitting the tow to be readily moved as compared to previous tows, such as chair lifts or "T" bars, which require concrete foundations or other fixed structural supports.

At their upper ends the legs 12 have tubular sleeves 22 encircling the tubular cross bar 14 so that the angularity of the legs 12 with respect to the bar 14 may be adjusted. To hold the legs 12 in position on the bar 14 a bolt 24 passing through a nut 26 welded to the sleeve 22 is provided. The bolt 24 may be threaded through the nut 26 to engage the outer surface of the tubular cross bar 14 and lock the sleeve 22 and its associated leg 12 from unintentional removal off the end of the tubular bar 14.

As further shown in FIGS. 1 and 2 the cross bars 14 support a "U" shaped upper track 30 and a similar "U" shaped lower track 28.

At the upper end of the slope suitable supports 32 (also easily moved) rest upon railroad ties or the like 32' and support an axle 34 which in turn carries a wheel 36 such as a tractor wheel and tire. The axle 34 is driven by any suitable means (not shown) such as an electric motor operating through a speed reduction gear mechanism. At the lower end of the slope similar supports 38 rest upon ties 38' and support an axle 40 which has secured thereto another wheel and tire such as a tractor wheel and tire 42. The wheel and tire 42 will rotate on the axle 40 by virtue of its engagement with a line 50 which is continuous and is trained around the wheel 42 and the driving wheel 36. The line 50 is preferably a synthetic fiber rope but may be natural fiber or a wire cable.

Figure 3:
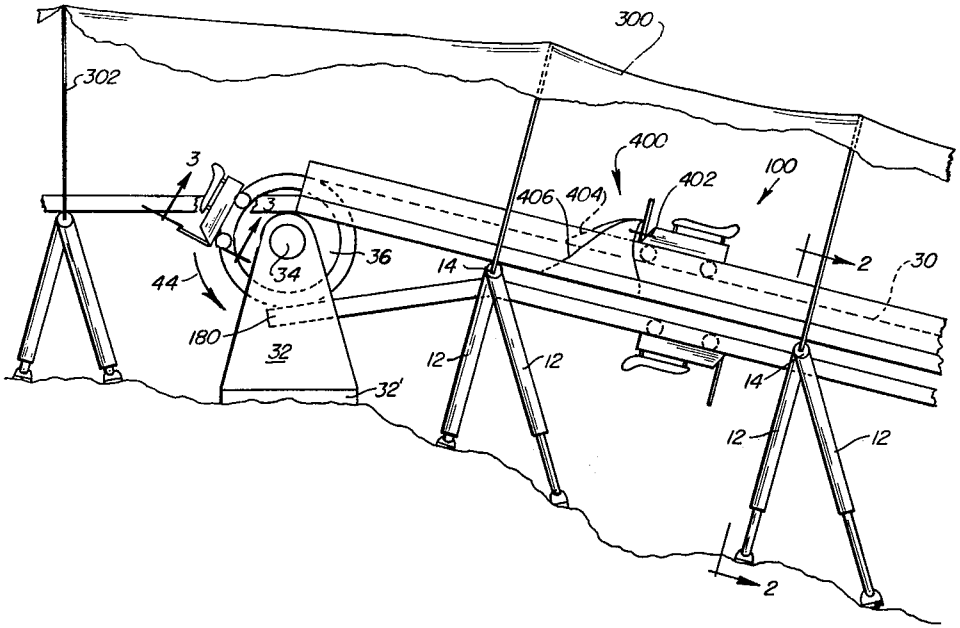
FIG. 3 is an enlarged cross section taken on line 3—3 of FIG. 1.
Figure 3:
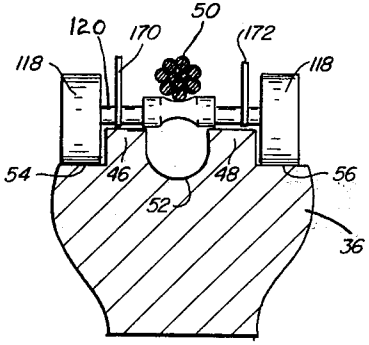

The line 50 passes upwardly from the lower wheel 42 through the center of the "U" channel 30, then around the driving tire 36, and then down the slope within or slightly beneath the lower "U" channel 28. The rope is driven in the direction of the arrow 44 by virtue of its frictional engagement with the driving wheel 36 as best shown in FIG. 3. As shown in FIG. 3, the tire 36 has two ribs 46 and 48 on its outer surface with three grooves 52, 54 and 56 therein. The groove 52 between the ribs 46 and 48 is dimensioned to securely hold the line 50 therein and since the tire is rubber will frictionally engage the same and drive the rope in the direction indicated by the arrow 44. The wheel 42 has a similar cross section to that shown in FIG. 3 for the wheel 36 and accordingly the wheel 42 is driven by the rope 50.

As best shown in FIG. 2 the channel 30 has on each side thereof two larger and upwardly facing channels 58 and 60 which provide for reception of the skis of a skier riding astride the car of the ski lift. These channels 58 and 60 comprise a lower horizontal portion 62 and 64 respectively which are bolted or riveted to flat plates 66 and 68 respectively arranged at intervals along the length of the channels 58 and 60. The plates 66 and 68 are provided at each of the tubular cross bars 14 and are suitably secured thereto as, for example, by welding. The portions 62 and 64 of the channels 58 and 60 are surfaced with any suitable antifriction material such as a bristle mat, synthetic carpeting, plastic, or the like which is also weather resistant. Thus a skier sitting on a car 100 may place his skis on either side of the track 30 and resting on the surface 62' and 64' and ride up the lift without removing his skis. The skis will slide easily on the surfaces 62' and 64'. The inner portions of the channels 58 and 60 are indicated at 70 and 72 respectively and extend upwardly and inwardly from the lower portions 62 and 64 respectively. At their upper inner ends the sloped portions 70 and 72 of the channels 58 and 60 are turned inwardly at 74 and 76 respectively and thence downwardly and under the in-turned upper lips 80 and 82 of the channel 30. Thus the portions or lips 84 and 86 of the in-turned portions 74 and 76 respectively support the channel 30 by means of the flanges 80 and 82 of the channel 30.

It will be seen that the only support for the channel 30 is the engagement of its flanges 80, 82 in the flanges or lips 84, 86 respectively. Heavy sheet metal material is used for the channel 30 and the channels 58–70 and 60–72. It has been found that this provides excellent strength and rigidity thus permitting the use of support legs 12, described above, rather than expensive concrete foundations. Accordingly, the entire ski lift is portable and may be readily moved, lengthened, or shortened. Also contributing to this rigidity and to ease of assembly is the fact that the channel 30 telescopes into the upper ends of the support channels 58–70 and 60–72. The channel sections 30 as well as the channel 58–70 and the channel 60–72 are provided in modular lengths of, for example, 10 feet, though, of course, other modular lengths may be used. During assembly a modular length of "U" shaped channel 30 is slid lengthwise into a channel 58–70 and a channel 60–72 with its flanges 80, 82 engaged respectively with flanges 84 and 86. However, the channel 30 is slid into the channels 58–70 and 60–72 for only about half of its length. The next succeeding channels 58–70 and 60–72 will then be slid into the channel 30 until they abut the previous channels 58–70 and 60–72. In this way the assembly is continued and the channel 30 will bridge the abutted joints between successive sections of the channels 58–70 and 60–72. The use of modular lengths also aids in ready moveability, lengthening or shortening of the tow.

The lower channel 28 is supported from the cross bars 14 by any suitable means such as by welding the bottom portion 88 thereof to the cross bar 14.

Figure 4:
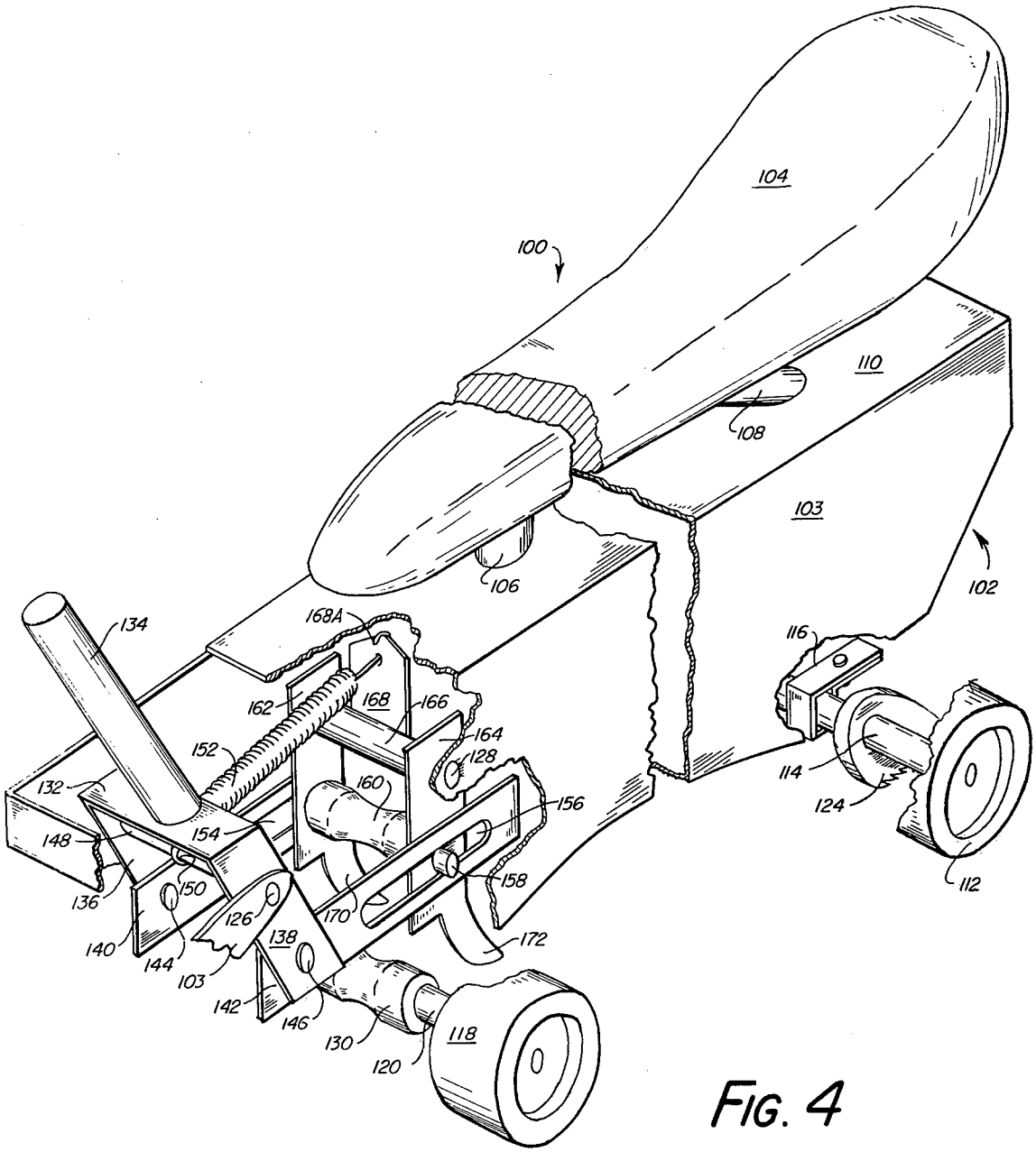
FIG. 4 is an enlarged perspective view of the car with portions broken away.

The cars used in carrying a skier up the slope are best shown in FIG. 4 in which the car 100 is shown as comprising a body portion 102 having a seat 104 supported therefrom by tubular supports 106 and 108 welded to the top portion 110 of the body 102. The seat 104 may be of a conventional or modified banana-type seat used with bicycles and has been found to be particularly advantageous since such a seat gives the rider a moderate forward and upward boost to an upright position as the rider dismounts at the top of the lift.

The rear portion of the car 100 is supported by means of wheels 112 supported by an axle 114 passing through suitable retainers 116 provided at the lower portion of each side 103 of the body 102.

At its forward end the body 102 is supported by wheels 118 supported on an axle 120 passing through similar clamps (not shown) provided at the lower forward end of the body. The wheels 112 and 118 rotate about the axles 114 and 120 respectively. The axle 120 has journalled thereon a grooved roller 130 for reasons hereinafter described. The rearward axle 114 has journalled thereon between the wheels 112 and the sides of the body two cam-shaped brakes 124 (only one such cam being shown). The wheels 112 and 118 are of size to fit under the flanges or lips formed on the upper track 30, and also within the lips of the lower track or channel 28.

At its forward end the car 100 carries two rods 126 and 128 secured in suitable openings in the sides of the inverted "U" shaped body 102. Journalled on the forward one of these rods 126 is an inverted "U" shaped actuating member 132. This actuating member has secured thereto an upwardly extending handle 134. The actuating member 132 has two parallel legs 136 and 138. At their lower ends the side members 136 and 138 have pivotally secured thereto two rearwardly extending slotted bars 140, 142 respectively. The bars 140, 142 may be pivoted to the side members 136, 138 by means of headed pins 144 and 146 respectively which pass through suitable openings in the slotted bars 140, 142 and are welded on their outer end of the side bars 136 and 138.

The actuating members 132 is journalled on the rod 126 by means of a loose fitting tubular member 148 which has a flange 150 to which is secured through an opening thereon one end of a spring 152.

The rearwardly extending slotted bars 140, 142 have slots 154, 156 respectively therein for receipt of a short axle 158 having journalled thereon a second grooved roller 160. The axle 158 is supported by two side supports 162, 164 which are secured at their upper end to a tubular member 166 journalled upon the axle 128. The tubular member 166 has secured thereto as by welding an upwardly extending arm 168 having an opening 168A therein for receipt of the other end of the spring 152.

Figure 5:
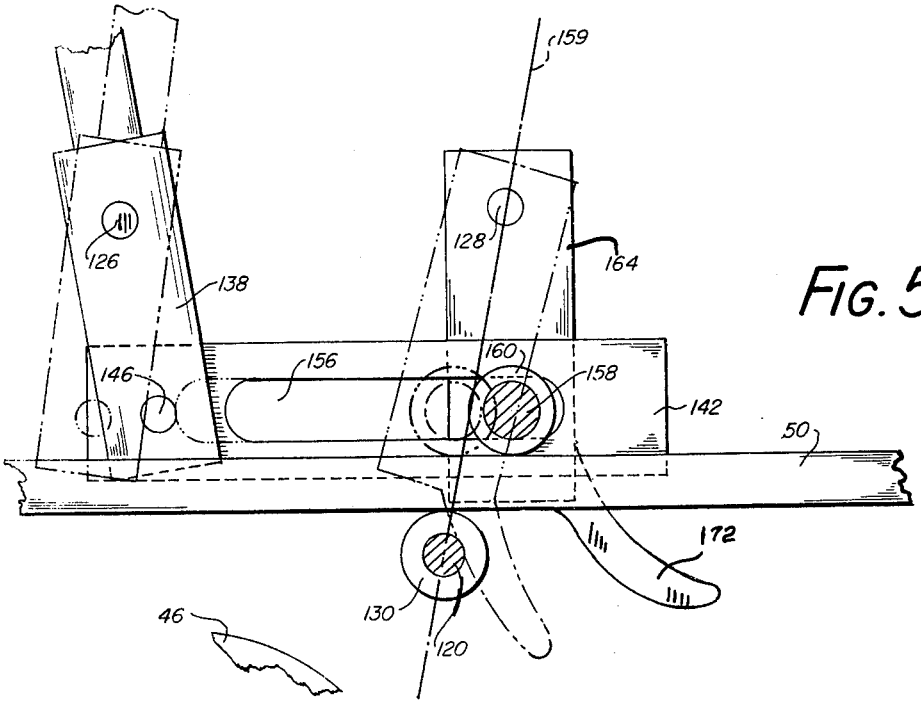
FIG. 5 is a detail of the line engaging portion of the car.

It will be seen from FIG. 4 and FIG. 5 that upon seating himself upon the seat 104 of the car 100 the skier may pull the actuating handle 134 rearwardly thus moving the slotted actuating bars 140, 142 forwardly. This movement will cause the rearward ends of the slots 154, 156 to engage the extending ends of the rod 158 to urge it forwardly about the axle 128. As shown in FIG. 5 the axis of the roller 160 in its disengaged position (shown in solid lines in FIG. 5) is to the right of the line 159 passing through the axis of the axle 128 and the axis of the roller 130. After the actuating handle 134 is pulled rearwardly by the rider, the axis of the roller 160 is positioned to the left of the line 159 (shown in dotted lines in FIG. 5). It will be appreciated that this comprises an "over center" arrangement whereby the rope 50 is firmly pinched between the rollers 130 and 160 and any forward movement of the rope relative to the cart (such as any tendency for the cart to move backwards) tends to hold the rope in such a pinched condition thus insuring against accidental disengagement. When so engaged, of course, the cart moves up the slope being moved by the rope 50 and supported by the wheels 112, 118. It will also be seen that by virtue of the slots 154, 156 forward movement of the handle will not disengage the rollers 130, 160 from the rope 50 and accordingly a rider may not disengage his car with the attendant danger of rolling backwardly into the following car.

In order to disengage the car from the rope suitable trips 170, 172 extend downwardly from the side supports 162, 164 for engagement with the driving wheel 36 as best shown in FIG. 3 where the trips 170 and 172 are shown in engagement with the upwardly extending ribs 46, 48 of the wheel 36. By virtue of this engagement the trips 170, 172 will be moved rearwardly (see FIG. 5) thus moving the roller 160 away from the roller 130 and disengaging the car from the rope at the time that it passes about the top of the rubber tire 36.

After release from the rope, the car 100 will continue around the tire 36 since the wheels 118 are held downwardly in engagement with the grooves 54 and 56 of the tire by virtue of the fact that the rope 50 is entrained over the roller 130 and the axle 120 therethrough. This tends to "pinch" the axle, roller, and wheels 118 between the rope 50 and the rubber tire 36.

After having passed completely around the tire 36 this "pinched" relationship will no longer exist and the car 100 can enter the upper end 180 of the channel 28 where it will be supported by the wheels 118 and 112 in an inverted position. From this point the car 100 will travel down the slope by friction of the rope on the pinch rollers or gravity while being supported by the channel 28.

While the return of the carts to the bottom end of the lift has been shown as being by a free run due to gravity, suitable mechanism can be provided to engage the carts to the return run of the rope 50 in order to control the descent of the carts and avoid excessive descent speed that might damage the carts. In such an arrangement the descending carts provide some counterweight to the ascending loaded carts thus decreasing power requirements somewhat.

Figure 6:
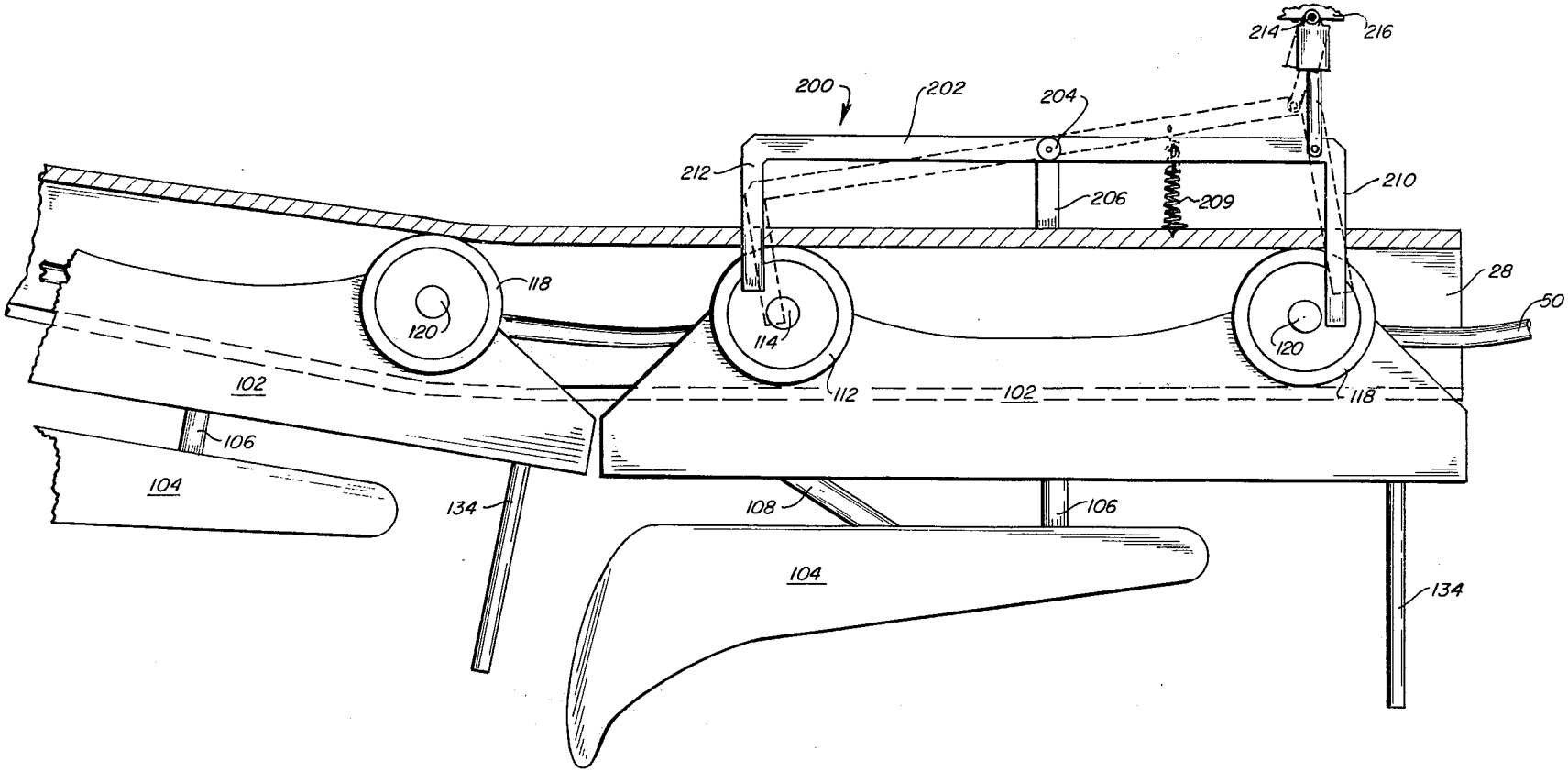
FIg. 6 shows the car spacing mechanisms.

As shown in FIG. 6 the car 100 will travel down the track 28 until it is stopped by engagement with the rearward end of a preceding car 100 or until it comes into contact with the stop mechanism generally indicated by the reference numeral 200. The stop mechanism 200 comprises a pivoted bar 202 pivoted at 204 from an upstanding side support 206 which in turn is secured to the upper surface of the inverted "U" channel 28. The pivoted bar 202 has a downwardly extending stop 210 which extends through a suitable opening in the upper surface of the "U" channel 28 and passes into the channel 28 to a sufficient distance to engage the axle 120 of the car 100. The bar 202 is of greater length than the distance between the axles 120 and 114 and at its other end the bar 202 has a depending arm 212. The arm 212 passes through a suitable opening in the upper surface of the channel 28 well rearwardly of the axle 114 of any car 100 that is in position with its axle 120 in engagement with the stop 210. A solenoid 214 may be actuated as hereinafter described to raise the stop 210 out of engagement with a car 100 to permit it to continue downwardly in its path within the channel 28. When the arm 202 pivots to raise the stop 210, the rearward arm 212 is extended downwardly into its dotted line position to engage the front portion, axle, or wheel of the next succeeding car in order to permit the car just released to continue on its path and thus space the cars. When the solenoid 214 is deactivated as hereinafter described the arm 202 returns to its solid line position as shown in FIG. 6 thus permitting the downwardly depending arm 212 to release any car it has stopped and permitting it to move forward to engagement with the stop 210. The solenoid is secured, as indicated in FIG. 6, to one end of the arm 202 and is pivoted at 214' to a fixed portion 216 of the adjacent supporting framework. Suitable switches, hereinafter described, are used to activate and deactivate the solenoid.

As shown in FIG. 1 a limit type switch 220 is positioned a short distance up the track 30. Upon sitting upon the car 100 and pulling back on the handle the skier will be carried up the track and past the switch 220 which will activate the solenoid 214 to raise the stop 210 and permit the car 100 trapped thereby to travel downwardly along the track 28 and particularly along the lower portion 224 of the track 28. Upon striking the limit switch 222 the car 100 will deactivate the solenoid 214 permitting the spring 209, which is fixed at its ends to the channel 28 and the arm 202, to lower the stop 210 and raise the stop 212 which has held back successive cars. Thereupon the next car will enter the stop block and come up against the stop 210 in preparation for the next activation of the switch 220 by the next skier going the slope.

Meanwhile the previous car 100 after having struck the limit switch 222 will be pinched between the rope 50 and the rubber tire 42 and carried around the rubber tire 42 and passed a short distance up the channel 30 by its inertia. The car 100 will be prevented from going back down the slope along the track 30 by means of the brake cams 124 which engage the inner bottom surface of the channel 30. Such cams will also brake the car at any time it may tend to move rearwardly in the track 30 such as in the event the line broke.

It will be appreciated that other mechanisms than the pivoted bar 202 may be used to space the cars including, for example, a parallelogram linkage arrangement which would permit the stop bars 210 and 212 to move rectilinearly rather than in an arc. Similarly, direct acting mechanical linkage could be provided instead of the solenoids shown.

Since the ski tow is habitually used in areas exposed to severe weather, a problem arises with respect to snow, sleet, freezing rain and the like. In order to protect against the elements, a suitable shelter may be provided. As shown in FIG. 1 the shelter comprises a plurality of frames 302 supported from the cross bars 14 and extending up and over the upper track 30 and any skier riding on cars 100 passing up the slope. A suitable plastic or canvas cover 300 is supported by the frame member 302 thus to protect the device and any skier riding thereon.

Figure 7:
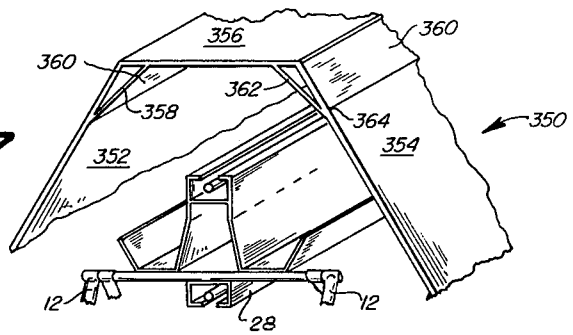
FIG. 7 shows a modified form of shelter.

An alternative shelter arrangement is shown in FIG. 7 as comprising truncated "A" frame sections 350 comprising side frame members 352, 354 and a top section 356. Suitable braces 358 and 362 are provided to strengthen the structure. The frame sections 350 rest at their bottom directly upon the ground and are provided in sections to be assembled end to end. Windows 360 may be provided and hinged at their bottom at 364 which may be opened in relatively warm weather. Suitable heating, lighting and sound systems may be provided in either of the shelters, if desired.

Still another covering can be provided supported by the legs 12 to enclose the underside of the track to prevent snow build-up beneath the lift in order to permit free passage of the returning cars.

As an alternate, when it is not desired to incur the cost of a shelter, means are provided for clearing the track 30 and the channels 58–70 and 60–72. As shown in FIG. 1, a snow plow 400 may be secured by a bracket 402 to a car 100 by bolting, clamping, or otherwise attaching the same to the car. The plow has a portion 404 extending downwardly into the track 30 and side portions 406 extending downwardly into the channels 58–70 and 60–72. Upon attaching the plow 400 to a car 100 and operating the device, the plow 400 will suitably plow the track and ski channels and may then be removed.

Similarly, an electrical heat tape 31 (as shown in FIG. 2 can be provided to prevent frozen snow or ice from building up in the track.

As an alternate means of connecting the plow 400 to the driving line 50 a line pinching arrangement such as used on the cars may be used and the plow may then be connected directly to the line.

While reference has been made herein to the use of the lift specifically as a ski lift, it is to be understood that the lift has general utility for carrying passengers up a slope. For example, it may be used to carry passengers without any skis, it being necessary only that the passenger's foot gear slide readily upon the surfaces 62' and 64'. Also, depending stirrups may be provided on the carts which extend downward close to the surfaces 62' and 64' on which a rider with unsuitable foot gear could rest his feet.

The rope 50 can initially be split and then threaded through the gripping devices on the cars 100 and then spliced to make a continuous rope, in a conventional manner.

What is claimed is:

1. In a ski tow having a track, an endless line, power means to move one reach of said line up a slope, a wheeled seat supported by said track, and means for connecting said seat to said line to move said seat up said slope on said track, the improvement comprising said connecting means including a first rotatable line engaging roller supported in a fixed position relative to said seat, a second rotatable line engaging roller supported on a pivot relative to said seat whereby said second roller is rotatable about its own axis and is movable through an arc about said pivot, said rollers being positioned on opposite sides of said line, manually operated lever means for moving said second roller about said pivot from a first position in which said line may move through said rollers without moving said seat to a second position in which said line is pinched between said rollers to move said seat up the slope, said manually operable lever means being inoperative to move said second roller from said second position back to said first position whereby the rider of said seat may control the engagement of said seat to said line but may not disengage said seat from said line.

2. The article of claim 1 including trip means for automatically moving said second roller from its second position to its first position to disengage said seat from said line at the top of the slope.

3. The article of claim 2 wherein said trip means comprises a downwardly extending trip extending to an opposite side of said line from said second roller, and a member mounted on said track at the upper end of said slope adapted to engage said downwardly extending dogs and move said second roller back to said first position.

4. In a ski tow having a track, an endless line, power means to move one reach of said line up a slope, a wheeled seat supported by said track, and means for connecting said seat to said line to move said seat up said slope on said track, the improvement comprising said connecting means including a first rotatable line engaging roller supported in a fixed position relative to said seat, a second rotatable line engaging roller supported on a pivot relative to said seat whereby said second roller is rotatable about its own axis and is movable through an arc about said pivot, said rollers being positioned on opposite sides of said line, manually operated lever means for moving said second roller about said pivot from a first position in which said line may move through said rollers without moving said seat to a second position in which said line is pinched between said rollers to move said seat up the slope, said lever means being pivotally mounted at locations spaced from said pivot, and a connecting link between said lever means and said second roller including a slot providing lost motion linkage permitting movement of said second roller toward said second position and being ineffective to move said second roller away from said second position.

5. In a ski tow having a track, an endless line, power means to move one reach of said line up a slope, a wheeled seat supported by said track, and means for connecting said seat to said line to move said seat up said slope on said track, the improvement comprising said connecting means including a first rotatable line engaging roller supported in a fixed position relative to said seat, a second rotatable line engaging roller supported on a pivot relative to said seat whereby said second roller is rotatable about its own axis and is movable through an arc about said pivot, said rollers being positioned on opposite sides of said line, manually operated lever means for moving said second roller about said pivot from a first position in which said line may move through said roller without moving said seat to a second position in which said line is pinched between said rollers to move said seat up the slope, an elongated support member, said second rotatable line engaging roller being rotatable supported on said elongated support member, said elongated support member being mounted on said pivot at location spaced from the axis of said second roller.

6. The article of claim 5 wherein said pivot is positioned in relation to said first roller so that as said power means moves said one reach of said line up a slope, drag from said line acting on said second roller tends to pinch said line between said first and second rollers.

* * * * *